US007570904B2

(12) United States Patent
Yaguchi et al.

(10) Patent No.: US 7,570,904 B2
(45) Date of Patent: Aug. 4, 2009

(54) IMAGE FORMING APPARATUS

(75) Inventors: Shigenori Yaguchi, Ibaraki (JP); Junji Kobayashi, Ibaraki (JP); Hirobumi Ouchi, Ibaraki (JP); Tomonari Hokkyo, Ibaraki (JP)

(73) Assignee: Ricoh Printing Systems, Ltd., Tokyo (JP)

( * ) Notice: Subject to any disclaimer, the term of this patent is extended or adjusted under 35 U.S.C. 154(b) by 411 days.

(21) Appl. No.: 11/137,342

(22) Filed: May 26, 2005

(65) Prior Publication Data

US 2005/0271428 A1 Dec. 8, 2005

(30) Foreign Application Priority Data

May 28, 2004 (JP) ..... P2004-158592

(51) Int. Cl.
*G03G 15/09* (2006.01)

(52) U.S. Cl. ..... 399/282; 399/222; 399/252; 430/106.3; 430/110.4; 430/111.1; 430/111.32; 430/111.35

(58) Field of Classification Search ..... 399/282, 399/222, 252; 430/122, 106.3, 110.4, 111.1, 430/111.32, 111.35
See application file for complete search history.

(56) References Cited

U.S. PATENT DOCUMENTS 5,139,916 A * 8/1992 Ciccarelli ..... 430/137.21
7,026,086 B2 * 4/2006 Kashiwabara et al. .... 430/108.4
7,247,413 B2 * 7/2007 Kido et al. ..... 430/110.2
7,258,959 B2 * 8/2007 Nakayama et al. ..... 430/109.4
2004/0253529 A1 * 12/2004 Baba et al. ..... 430/111.35
2005/0250191 A1 * 11/2005 Imamura et al. ..... 435/135

FOREIGN PATENT DOCUMENTS

| | | |
|---|---|---|
| JP | 4-204660 | 7/1992 |
| JP | 6-175391 | 6/1994 |
| JP | 10-97095 | 4/1998 |
| JP | 11-305515 | 11/1999 |
| JP | 2000-137351 | 5/2000 |
| JP | 2004-053883 | 2/2004 |
| JP | 2004-077577 | 3/2004 |

* cited by examiner

*Primary Examiner*—Hoa V Le
(74) *Attorney, Agent, or Firm*—McGinn IP Law Group, PLLC

(57) ABSTRACT

In the image forming apparatus by: visualizing an electrostatic latent image formed on an electrostatic charge carrying member; transferring a toner image, which is thus visualized, to a recording medium, or to a recording medium through an intermediate transfer material; and fixing the toner image, which is thus transferred to the recording medium, to obtain a recorded image, the toner includes at least a fixing resin, a colorant, a releasing agent, and an external additive, the toner has an average particle diameter in a range of from 4 to 12 μm and including no particle having a diameter of 45 μm or more, a ratio of a toner adhesion amount in a character part to a toner adhesion amount in a solid image part upon printing is more than 0.5 and less than 4, and the toner adhesion amount in a character part is 1.6 mg/cm$^2$ or less.

20 Claims, 1 Drawing Sheet

IMAGE FORMING APPARATUS

BACKGROUND OF THE INVENTION

1. Field of the Invention

The present invention relates to an image forming apparatus for visualizing an electrostatic latent image formed in such a process as an electrophotographic process, an electrostatic printing process and an electrostatic recording process.

2. Description of the Related Art

According to the colorization of an image forming apparatus in recent years, a non-magnetic one-component color toner using no magnetic carrier is often used in general-purpose color printers, and a magnetic brush developing method using a two-component developer is generally employed in high-speed printers.

In the electrophotographic process, a photoconductive photoreceptor is charged and exposed to form an electrostatic latent image on the photoreceptor. The electrostatic latent image is then developed with a toner in a fine particle form including a colorant and a resin as a binder. The resulting toner image is transferred and fixed to recording paper to obtain a recorded image.

In a latest color image forming apparatus, an intermediate transfer material, such as an intermediate transfer belt, is used, in which the toner is transferred from the photoconductive photoreceptor to the intermediate transfer material to form plural toner images on the intermediate transfer material, and the toner images are then transferred to recording paper.

It is an important step in an image forming apparatus that a toner image developed on a photoconductive photoreceptor is transferred to recording paper to obtain a final image.

There are some cases in the image forming apparatus that dropout occurs upon transferring, whereby white spots and density unevenness are formed in a final image on a transfer material, such as recording paper, or the image is locally not transferred to form so-called worm holes.

The white spots and density unevenness are confirmed as unevenness in a solid image with a large area or failure in gradation in a half-tone image.

In order to avoid the white spots and density unevenness, such a proposal has been made that relates to a particle size distribution of a toner (for example, in JP-A-4-204660 and JP-A-6-175391) and such a proposal has been made that relates to a weight of a residue remaining after sieving a toner (for example, in JP-A-2000-137351).

However, the proposals are still insufficient to leave rooms for improvement although there have been tendencies to avoid the white spots and density unevenness.

There is a proposal for avoiding transfer failure like worm-holes by defining the circularity of the toner (for example, in JP-A-10-097095), but there are cases where the transfer failure occurs depending on recording paper.

The toner amount that is consumed upon printing in an image forming apparatus using a color toner often varies largely depending on the kind of printed images. For example, a large amount of a toner is consumed upon printing an image with a large printing density, such as a graphic image, and a consumed amount of a toner is significantly small upon printing an image with a small printing density, such as an image including only characters. The toner consuming amount largely varies depending on an image to be printed, and in the case where many images with a small printing density are printed, the toner is agitated in the developing device in many times, whereby an external additive attached to the toner surface is buried in the toner due to the agitation stress in the developing device to cause deterioration in fluidity and change in charging property, which facilitate occurrence of transfer failure.

SUMMARY OF THE INVENTION

It is an object of the invention to provide an image forming apparatus that provides stable image formation by preventing white spots and density unevenness occurring upon transferring, prevents occurrence of transfer failure, such as worm holes, due to difference in recording paper, and ensures stable image formation upon fluctuating in printing density.

As a result of earnest investigations made by the inventors, the object can be attained by following aspects of the invention.

According to one aspect of the invention, there is provided with an image forming apparatus including: an electrostatic charge carrying member on which an electrostatic latent image is formed to be visualized, a transferring member transferring a toner image to be visualized to a recording medium or to the recording medium through an intermediate transfer material; and a fixing member fixing a toner image, which is thus transferred to the recording medium, to obtain a recorded image, wherein a toner includes at least a fixing resin, a colorant, a releasing agent, and an external additive. The toner has an average particle diameter in a range of from 4 to 12 μm and including no particle having a diameter of 45 μm or more. A ratio of a toner adhesion amount in a character part to a toner adhesion amount in a solid image part upon printing is more than 0.5 and less than 4, where the toner adhesion amount in a character part is 1.6 mg/cm$^2$ or less.

According to another aspect of the invention, there is provided with an image forming apparatus including: an electrostatic charge carrying member on which an electrostatic latent image is formed to be visualized, a transferring member transferring a toner image to be visualized to a recording medium or to the recording medium through an intermediate transfer material; and a fixing member fixing a toner image, which is thus transferred to the recording medium, to obtain a recorded image. A toner image is formed with a two-component developer including; a toner having at least a binder resin, a colorant, a releasing agent, and an external additive, and having an average particle diameter in a range of from 4 to 12 μm and including no particle having a diameter of 45 μm or more; and a magnetic carrier. A ratio of a toner adhesion amount in a character part to a toner adhesion amount in a solid image part upon printing is more than 0.5 and less than 4, where the toner adhesion amount in a character part is 1.6 mg/cm$^2$ or less.

According to another aspect of the invention, there is provided with an image forming apparatus including: a developing device including; a first developing magnetic roller rotating in the same direction as a traveling direction of the electrostatic charge carrying member; and a second developing magnetic roller rotating in the opposite direction to a traveling direction of the electrostatic charge carrying member. The developing device visualizes an electrostatic latent image formed on an electrostatic charge carrying member, transfers a toner image, which is thus visualized, to a recording medium, and fixes the toner image, which is thus transferred to the recording medium, to obtain a recorded image. The toner image is formed with a two-component developer including: a toner having at least a binder resin, a colorant, a releasing agent, and an external additive, and having an average particle diameter in a range of from 4 to 12 μm and including no particle having a diameter of 45 μm or more; and a magnetic carrier. A ratio of a toner adhesion amount in a character part to a toner adhesion amount in a solid image part upon printing is more than 0.5 and less than 4 where the toner adhesion amount in a character part is 1.6 mg/cm$^2$ or less.

By the above aspects, an image forming apparatus can be provided that provides stable image formation by preventing white spots and density unevenness occurring upon transferring, prevents occurrence of transfer failure, such as worm holes, due to difference in recording paper, and ensures stable image formation upon fluctuating in printing density.

DESCRIPTION OF THE PREFERRED EMBODIMENTS

Figure 1:
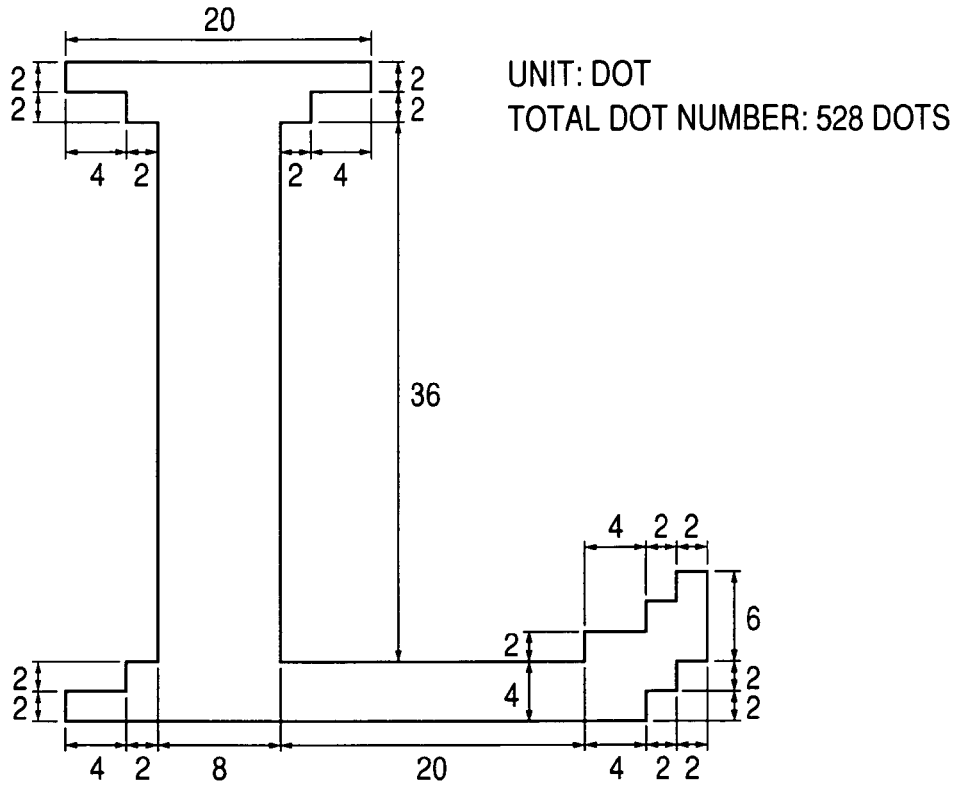
FIG. 1 is a constitutional view showing a dot structure of an L-pattern used for calculating the toner adhesion amount in a character part.

Embodiments of the invention will be described in detail below.

A toner of the embodiment includes at least a fixing resin, a colorant, a releasing agent, and an external additive, and the toner has an average particle diameter in a range of from 4 to 12 μm and including no particle having a diameter of 45 μm or more. The toner has a ratio R of a toner adhesion amount in a character part to a toner adhesion amount in a solid image part upon printing satisfying the following equation (1), provided that the toner adhesion amount in a character part is 1.6 mg/cm$^2$ or less.

$$0.5<R<4 \quad (1)$$

It has been recognized in the art that white spots and density unevenness upon transferring occur due to toner aggregates or coarse particles included in a toner or large particles included in an external additive, and the problem can be solved by the proportion of them in the toner.

According to the investigations made by the inventors, however, white spots and density unevenness upon transferring significantly vary in frequency of occurrence depending on the number of printed sheets and the printed density in the image forming apparatus, and they frequently occur under certain conditions.

That is, it has been found that white spots and density unevenness upon transferring hardly occur when the toner or the two-component developer is fresh, and are increased in frequency of occurrence with increase of the number of printed sheets, and they hardly occur with a high printing density but are liable to occur with a low printing density. It has also been found that upon printing with a high printing density after printing in a large amount with a low printing density, the first printed sheet suffers the most significant white spots and density unevenness, but the white spots and density unevenness are reduced upon increasing the number of printed sheet, i.e., the second sheet and the third sheet.

It is understood from the above that a transfer failure substance is consumed with a high printing density, but it is less consumed with a low printing density and selectively accumulated in the toner or the two-component developer. The transfer failure substance thus accumulated brings about transfer failure upon printing an image with a high printing density.

In the case where the printing density is low, the toner is consumed from a toner with good developability, and a toner with poor developability is accumulated in the developing device. Upon printing an image with a high printing density under the condition, the toner is necessarily developed in a large amount, whereby the toner with poor developability is also developed at the same time. The toner with poor developability includes a toner having a high charge amount and aggregates and coarse particles having a large particle diameter, and the toner having a large charge amount often has a small particle diameter and thus hardly causes white spots and density unevenness. It is considered that the aggregates and coarse particles having a large particle diameter suffers adhesion failure between the photoconductive photoreceptor and the recording paper or the intermediate transfer material upon transferring to cause transfer failure.

As a result of investigations with respect to the aggregates and coarse particles having a large particle diameter, which cause transfer failure, it has been found that transfer failure occurs when particles having a diameter of 45 μm or more are included.

Therefore, even in the conventional proposals relating to a particle size distribution and a weight of a residue remaining after sieving a toner, white spots and density unevenness occur when a toner includes a particle diameter of 45 μm or more. The transfer failure substance is consumed upon continuously printing with a high printing density, to prevent white spots and density unevenness from becoming severe. In the case where an image with a high printing density is printed after printing a large amount of images with a low printing density, white spots and density unevenness becomes severe due to the transfer failure substance thus accumulated.

The inventors have confirmed that in the case where 20,000 sheets are printed with a printing density of 1.5%, and then a solid image (printing density: 100%) and a half-tone image, such as an image with repeated 4 printed dots and 4 non-printed dots (printing density: 50%), are printed, white spots and density unevenness do not occur when the toner includes no particle having a diameter of 45 μm or more.

The size of the particles can be controlled by removing particles having a prescribed diameter by passing the toner through a sieve having a prescribed mesh defined by JIS Z8801 with such an apparatus as a vibration sieve. There may be such a possibility that the toner after sieving is aggregated, but aggregated particles are not firmly coagulated and can be easily broken, and white spots and density unevenness due to adhesion failure do not occur.

Accordingly, white spots and density unevenness can be prevented from occurring by including no particle having a diameter of 45 μm or more in the toner. In the case where the toner includes particles having a diameter of 45 μm or more, the extent of white spots and density unevenness becomes severe when the content thereof is increased, and the area of white spots and density unevenness is expanded to accentuate transfer failure when the particle diameter of the particles is larger.

Upon investigating worm holes, on the other hand, it has been found that the occurrence of worm holes varies depending on the thickness of recording paper, and worm holes are liable to occur with recording paper having a larger thickness.

In consideration of the toner adhesion amount in a character part during the investigations to solve the problem, it has been found that worm holes are liable to occur when the toner adhesion amount in a character part is larger, and worm holes hardly occur when the toner adhesion amount in a character part is small even with recording paper having a large thickness. Therefore, it can be understood that worm holes occurs because the toner is aggregated under pressure by pressing onto the recording paper, whereby the toner cannot be transferred thereto.

It has been confirmed that substantially no worm hole occurs when the toner adhesion amount in a character part is 1.6 mg/cm$^2$ or less even with thick paper, such as 135-kg paper, used as recording paper.

The toner adhesion amount in a character part in the embodiment of the invention is calculated in the following manner. An L-pattern having the dot structure and printing density shown in FIG. 1 (total dot number: 528 dots) is printed on an OHP sheet, which suffers no change in weight upon heating, and the toner adhesion amount in a character part is calculated from the change in weight of the OHP sheet before and after printing. The printing density of the L-pattern is 10.3%.

The edge effect is found in the electrophotographic process, in which a toner is adhered in a large amount at an edge part of an image. Worm holes are liable to occur when a large amount of a toner is developed in the edge part.

In the case where the image forming conditions are controlled to increase the developing amount in a character part, the reproducibility of thin lines is improved, but worm holes are liable to occur, whereby the developing amount in a large area, such as a solid image, is rather decreased, which facilitates reduction in image density. In the case where the image forming conditions are controlled to increase the developing amount in a large area, on the other hand, the developing amount in a character part is decreased to thin down characters, whereby characters are difficult to recognize.

There is an optimum condition in the toner adhesion amount in a character part and the toner adhesion amount in a solid image part, and it has been found that in the case where the ratio of the toner adhesion amount in a character part to the toner adhesion amount in a solid image part is more than 0.5 and less than 4, the uniformity in a solid image part, the sufficient image density and recognizable characters can be attained all at the same time, and worm holes can be prevented from occurring. Thus, the embodiment of the invention has been completed.

The developing amount in a character part and the developing amount in a solid image part can be controlled by the developing conditions of the developing device, such as the rotation number of the magnetic roll, the developing gap and the developing bias potential, the electric resistance of the magnetic carrier, and the toner concentration, and can also be adjusted by a laser light amount for exposing the photoconductive photoreceptor.

The toner adhesion amount in a solid image part is measured in the following manner. A solid latent image having a dimension of 2 cm×2 cm is formed, developed and transferred, and the image forming apparatus is stopped before entering the transferred image into the fixing step. The unfixed image on paper is taken out, and the toner on the solid image is sucked to measure the toner amount. The suction operation can be carried out with a compact suction charge amount measuring apparatus (Model 1219HS, produced by Trek Japan Co., Ltd.), and the increase in weight after sucking the toner on the solid image.

The problem can be solved by such an image forming apparatus that the image forming conditions are controlled to make the ratio of the toner adhesion amount in a character part to the toner adhesion amount in a solid image part fall in a range of more than 0.5 and less than 4, provided that the toner adhesion amount in a character part is 1.6 mg/cm$^2$ or less.

Examples of the binder resin used in the toner of the embodiment of the invention include the following.

Examples thereof include a homopolymer of styrene and a substituted compound thereof, such as polystyrene, poly-p-chlorostyrene and polyvinyltoluene; and a styrene copolymer, such as a styrene-p-chlorostyrene copolymer, a styrene-vinyltoluene copolymer, a styrene-vinylnaphthalene copolymer, a styrene-acrylate ester copolymer, a styrene-methacrylate ester copolymer, a styrene-methyl α-choromethacrylate copolymer, a styrene-acrylonitrile copolymer, a styrene-vinyl methyl ether copolymer, a styrene-vinyl ethyl ether copolymer, a styrene-vinyl methyl ketone copolymer, a styrene-butadiene copolymer, a styrene-isoprene copolymer and a styrene-acrylonitrile-indene copolymer; and also include a polyvinyl chloride resin, a phenol resin, a natural resin-modified phenol resin, a natural resin-modified maleic acid resin, an acrylic resin, a methacrylic resin, a polyvinyl acetate resin, a silicone resin, a polyester resin, a polyurethane resin, a polyamide resin, a furan resin, an epoxy resin, a xylene resin, a polyvinyl butyral resin, a terpene resin, a chroman-indene resin and a petroleum resin. Preferred examples thereof include a styrene copolymer and a polyester resin. A low hygroscopic resin obtained by graft polymerization of the polyester resin with styrene and an acrylate can also be used. The styrene polymer and the styrene copolymer may be crosslinked and may be a mixed resin. In order to fix a toner at a low temperature to prevent high temperature offset, in cases of the styrene resin and the (meth)acrylate resin, for example, a mixture of a high molecular weight polymer and a low molecular weight polymer may be used, in which the former is effective for offset resistance of a toner, and the later is effective for fixing strength. The compositional ratio of the two components is important for attaining the low temperature fixing property and the offset resistance simultaneously, and also it is noted that the compositional ratio influences on the storage stability. The molecular weight distribution of the styrene resin and the (meth)acrylate resin can be obtained by measuring the component soluble in tetrahydrofuran with gel permeation chromatography (GPC). The low temperature fixing property and the offset resistance can be attained simultaneously by controlling the ratio of a high molecular weight component having a molecular weight exceeding 500,000 and a low molecular weight component having a molecular weight of 20,000 or less to a range of from 20/80 to 60/40 as measured by GPC.

The polyester resin can be obtained, for example, by subjecting a dicarboxylic acid and a diol to dehydration condensation. Examples of the dicarboxylic acid include dicarboxylic acid, such as phthalic anhydride, terephthalic acid, isophthalic acid, orthophthalic acid, maleic acid, maleic anhydride, adipic acid, fumaric acid, itaconic acid, citraconic acid, succinic acid, malonic acid and glutaric acid, a derivative thereof, and an ester compound thereof.

Examples of the diol include ethylene glycol, diethylene glycol, propylene glycol, dipropylene glycol, tripropylene glycol, butanediol, pentanediol, hexanediol, bisphenol A, polyoxyethylene-(2.0)-2,2-bis(4-hydroxyphenyl)propane and a derivative thereof, polyoxypropylene-(2.0)-2,2-bis(4-hydroxyphenyl)propane, polyoxypropylene-(2.2)-polyoxyethylene-(2.0)-2,2-bis(4-hydroxyphenyl)propane, polyoxypropylene-(6)-2,2-bis(4-hydroxyphenyl)propane, polyoxypropylene-(2.2)-2,2-bis(4-hydroxyphenyl)propane, polyoxypropylene-(2.4)-2,2-bis(4-hydroxyphenyl)propane, polyoxypropylene-(3.3)-2,2-bis (4-hydroxyphenyl)propane and a derivative thereof, polyethylene glycol, polypropylene glycol, an ethylene oxide-propylene oxide random copolymer diol, an ethylene oxide-propylene oxide block copolymer diol, an ethylene oxide-tetrahydrofran copolymer diol and polycaprolactonediol.

The polyester can also be obtained by dehydration condensation in an ordinary manner using, in addition to the dicarboxylic acid and the diol, a polyfunctional carboxylic acid of three or more functionalities, or a derivative or an ester thereof, such as trimellitic acid, trimellitic anhydride, pyromellitic acid and pyromellitic anhydride, or a polyhydric alcohol of three or more functionalities, such as sorbitol, 1,2,3,6-hexanetetraol, 1,4-sorbitan, pentaerythritol, 1,2,4-butanetriol, 1,2,5-pentanetriol, glycerin, 2-methylpropanetriol, 2-methyl-1,2,4-butanetriol, trimethylolethane, trimethylolpropane and 1,3,5-trimethylolbenzene.

In order to improve the compatibility between the binder resin and wax, the binder resin may be produced by a coexistence polymerization method, in which wax is made coexistent in the entire or a part of the process for synthesizing the binder resin. The vinyl polymer produced by the coexistence polymerization method may include, as constitutional components, a styrene monomer and/or a (meth)acrylate ester monomer, and other vinyl monomers may be included.

Upon effecting the coexistence polymerization where wax is made coexistent in the entire or apart of the copolymerization process, a vinyl copolymer having wax uniformly dispersed therein can be obtained at least as a constitutional component thereof. The vinyl copolymer may be partially crosslinked with a crosslinking agent, such as a monomer having at least two polymerizable double bonds, e.g., divinylbenzene, divinylnaphthalene, ethylene glycol dimethacrylate, 1,3-butanediol dimethacrylate, divinylaniline, divinyl ether, divinylsulfide and divinylsulfone.

Specific examples of the styrene monomer as a constitutional component of the vinyl polymer include styrene, o-methylstyrene, m-methylstyrene, α-methylstyrene and 2,4-dimethylstyrene.

Specific examples of the acrylate ester monomer or the methacrylate ester monomer as a constitutional component of he vinyl polymer include an alkyl ester of acrylic acid or methacrylic acid, such as methyl acrylate, ethyl acrylate, propyl acrylate, n-butyl acrylate, isobutyl acrylate, n-octyl acrylate, dodecyl acrylate, 2-ethylhexyl acrylate, stearyl acrylate, methyl methacrylate, ethyl methacrylate, propyl methacrylate, n-butyl methacrylate, isobutyl methacrylate, n-octyl methacrylate, dodecyl methacrylate and stearyl methacrylate, and also include 2-chloroethyl acrylate, phenyl acrylate, methyl α-chloroacrylate, phenyl methacrylate, dimethylaminoethyl methacrylate, diethylaminoethyl methacrylate, 2-hydroxyethyl methacrylate, glycidyl methacrylate, bisglycidyl methacrylate, polyethylene glycol dimethacrylate and methacryloxyethyl phosphate. Among these, ethyl acrylate, propyl acrylate, butyl acrylate, methyl methacrylate, ethyl methacrylate, propyl methacrylate and butyl methacrylate are particularly preferably used.

Examples of the other vinyl monomers as a constitutional component of the vinyl polymer include an acrylic acid and an α- or β-alkyl derivative thereof, such as acrylic acid, methacrylic acid, α-ethylacrylic acid and crotonic acid, an unsaturated dicarboxylic acid and a monoester derivative and a diester derivative thereof, such as fumaric acid, maleic acid, citraconic acid and itaconic acid, as well as succinic acid monoacryloyloxyethyl ester, succinic acid monomethacryloyloxyethyl ester, acrylonitrile, methacrylonitrile and acrylamide.

Examples of the colorant used in the toner of the embodiment of the invention include various pigments and dyes, which may be arbitrarily selected. Examples of the pigment used as the colorant of the toner include carbon black, aniline black, acetylene black, naphthol yellow, hansa yellow, rhodamine lake, alizarin lake, red iron oxide, phthanocyanine blue, indanthrene blue, quinacridone, naphthol red and benzimidazolone, but the embodiment of the invention is not limited to them. The pigment may be used in such an amount that is sufficient to maintain the optical density and the color tone of the fixed image, and is preferably added in an amount of from 0.2 to 15% by weight based on the binder resin.

A dye may be used in the same purpose as the pigment. Examples of the dye include an azo dye, an anthraquinone dye, a xanthene dye and a methine dye, and the dye may be added in an amount of from 0.2 to 15% by weight based on the binder resin.

The toner of the embodiment of the invention may include a magnetic material. The magnetic material may also function as the colorant. Examples of the magnetic material included in the toner of the embodiment of the invention include iron oxide, such as magnetite, hematite and ferrite; a metal, such as iron, cobalt and nickel; an alloy of the metal with such a metal as aluminum, cobalt, copper, lead, magnesium, tin, zinc, antimony, calcium, manganese, selenium, titanium, tungsten and vanadium; and mixtures thereof.

The magnetic material preferably has an average particle diameter of 2 μm or less, and more preferably about from 0.1 to 0.5 μm, and the amount thereof to be added to the toner is preferably from 0.1 to 200% by weight based on the binder resin.

The electrophotographic toner of the embodiment of the invention includes a releasing agent as a constitutional component. In general, examples of are leasing agent frequently used for an electrophotographic toner includes polypropylene wax, polyethylene wax, paraffin wax, Fischer-Tropsch wax, candelilla wax, carnauba wax and rice wax, but the embodiment of the invention is not limited to them. The releasing agent may be used solely or as a combination of plural kinds of them, and is generally included in an amount of from 0.1 to 8 parts by weight, preferably from 1 to 4 parts by weight, per 100 parts by weight of the binder resin, whereby good offset resistance, fixing strength and rubbing strength can be obtained. In the case where the amount of the releasing agent is less than 1 part by weight, offset is liable to occur, and in the case where the amount exceeds 8 parts by weight, carrier consumption is liable to occur, and the image quality is liable to be deteriorated.

Examples of the external additive used in the embodiment of the invention include a powder lubricating agent, such as silica, fluorine resin powder, zinc stearate powder and polyvinylidene fluoride powder, an abrasive, such as cerium oxide powder, silicon carbide powder and strontium titanate powder, a fluidizing agent, such as titanium oxide powder and aluminum oxide powder, an aggregation preventing agent, and an electroconductive agent, such as carbon black, zinc oxide powder, antimony oxide powder and tin oxide powder. White particles and black particles having opposite polarities may be used as a developability improving agent. These may be used solely or in combination of plural kinds of them, and may be selected to provide resistance to developing stress, such as slippage.

Examples of magnetic particles used in the magnetic carrier include magnetite, spinel ferrite, such as gamma iron oxide, spinel ferrite including one or more of metals other than iron (e.g., Mn, Ni, Zn, Mg and Cu), magnetoplumbite ferrite, such as barium ferrite, and iron or alloy particles having an oxide layer on the surface thereof. The shape of the particles may be a granular shape, a spherical shape or an acicular shape. In the case where particularly high magnetization is required, ferromagnetic fine particles are preferably used. In consideration of chemical stability, magnetite, spinel ferrite including gamma iron oxide, and magnetoplumbite ferrite, such as barium ferrite, are preferably used. A resin carrier having a desired magnetization can be obtained by selecting the kind and the content of the ferromagnetic fine particles. As the magnetic property of the carrier, the magnetization thereof at 1,000 Oe is preferably from 30 to 150 emu/g.

The resin carrier can be produced, for example, by spraying a molten kneaded mixture of the magnetic fine particles and the insulating binder resin, reacting and curing a monomer or a prepolymer in an aqueous medium in the presence of the magnetic particles, so as to produce a resin carrier including a condensation binder resin having the magnetic particles dispersed therein.

The charging property of the magnetic carrier can be controlled by fixing positively or negatively charged fine particles or electroconductive fine particles on the surface of the carrier, or by coating the surface with a resin.

Examples of the material to be coated on the surface of the carrier include a silicone resin, an acrylic resin, an epoxy resin and a fluorine resin, which may include positively or negatively charged fine particles or electroconductive fine particles upon coating, and a silicone resin and an acrylic resin are preferably used.

The mixing ratio of the electrophotographic toner and the magnetic carrier in the embodiment of the invention is preferably from 2 to 10% by weight in terms of the concentration of the toner.

A charge controlling agent may be mixed in the toner particles (internal addition) or added thereto (external addition) to control the charge amount of the toner to a desired value.

Examples of a positive charge controlling agent for the toner include nigrosin and a modified product thereof with an aliphatic acid metallic salt; a quaternary ammonium salt, such as tributylbenzylammonium-1-hydroxy-4-naphtosulfonic acid and tetrabutylammonium tetrafluoroborate, and analogs thereof, such as an onium salt, e.g., a phosphonium salt, and a lake pigment thereof, a triphenylmethane dye and a lake pigment thereof, and a metallic salt of a higher fatty acid; a diorganotin oxide, such as dibutyltin oxide, dioctyltin oxide and dicyclohexyltin oxide; and a diorganotin borate, such as dibutyltin borate, dioctyltin borate and dicyclohexyltin borate, which may be used solely or in combination of two or more of them. Among these, such a charge controlling agent as a nigrosin compound, a quaternary ammonium salt and a triphenylmethane dye can be particularly preferably used.

As a negative charge controlling agent for the toner, an organic metal complex and a chelate compound are effectively used. Examples thereof include a monoazo metal complex, acetylacetone metal complex, and a metal complex of an aromatic hydroxycarboxylic acid and an aromatic dicarboxylic acid. Examples thereof also include an aromatic hydroxycarboxylic acid, an aromatic mono- and dicarboxylic acid and a metallic salt, an anhydride and an ester thereof, and a phenol derivative, such as bisphenol.

In the case where the charge controlling agent is internally added to the toner, the amount thereof is preferably from 0.1 to 10% by weight based on the binder resin. The charge controlling agent may have skin sensitizing property depending on the structure thereof, and thus it is necessary to select after sufficient investigation.

The particle diameter distribution of an electrophotographic toner can be measured in various methods, and in the embodiment of the invention, the measurement is carried out with Coulter Counter. The number distribution and the volume distribution are measured with Coulter Counter Model TA-II (produced by Beckman Coulter Inc.) using an aperture of 100 μm. A specimen to be measured is added to an electrolytic solution including a surfactant, and dispersed therein with an ultrasonic dispersion machine for 1 minute, and 50,000 particles of the specimen are measured. The toner preferably has an average particle diameter of from 4 to 12 μm, and the proportion of particles having a diameter of 4 μm or less included in the toner is preferably 15% by number or less. In the case where the proportion of particles having a diameter of 4 μm or less included in the toner is suppressed to 10% by number or less, the durability of the toner is also improved. In a two-component developer, a carrier and several percents of a toner are mixed to charge the toner through friction, and a toner having a diameter of 4 μm or less is hardly released from the carrier to make in contact with the carrier for a long period of time, whereby the toner is liable to be consumed on the carrier surface. The fine particle toner having a diameter of 4 μm or less causes attachment of the toner to a non-image part (fogging) and requires much heat energy upon fixing than a toner having a large particle diameter to provide disadvantage in low temperature fixing property. Therefore, the proportion of particles having a diameter of 4 μm or less in the toner is preferably 15% by number or less, more preferably 10% by number or less, and further preferably 8% by number or less, based on the total number of toner particles.

The electrophotographic toner of the embodiment of the invention can be produced in the following manner. A binder resin, a charge controlling agent, a pigment or a dye as a colorant and magnetic particles, or a master batch including a resin having a pigment or the like kneaded therein, are sufficiently mixed in a mixer, such as a Henschel mixer and a super mixer, along with a binder resin having an additive and a releasing agent uniformly dispersed therein depending on necessity, and the resulting mixture is subjected to melt kneading in a heat-melt kneading machine, such as a heating roller, a kneader and an extruder, to mix the ingredients sufficiently. The kneaded product is then solidified by cooling, and then pulverized and classified to obtain a toner. Examples of the pulverizing method herein include a jet mil method, in which a toner is carried by a high-speed air flow and pulverized by crashing the toner on a crashing plate, an inter-particle crashing method, in which toner particles are crashed on each other in an air flow, and a mechanical pulverizing method, in which a toner is pulverized by feeding to a narrow gap of a rotor rotating at a high speed. In the jet mil method and the inter-particle crashing method, the toner is pulverized with collision energy, and thus the shape of the toner particles is relatively angular. In the case where the mechanical pulverizing method is employed, the toner is pulverized under friction in the gap, and frictional heat forms upon pulverization, whereby the toner surface is liable to be spherical. In particular, upon producing a toner having a small diameter and low temperature fixing capability, such a phenomenon reported in JP-A-7-287413 can be avoided that a toner is melted and adhered on a crashing plate upon pulverization, and furthermore, deterioration in toner fluidity can also be prevented, which is a particular phenomenon occurring upon decreasing the particle diameter and mixing wax having a low molecular weight.

The toner can also be obtained by the so-called polymerization method, in which a monomer is polymerized in the presence of a colorant, a charge controlling agent, wax and the like. The toner can also be obtained by micro-encapsulation.

The toner thus obtained is added with a desired additive, depending on necessity, in a mixer, such as a Henschel mixer, to attach the additive to the toner, and thus a toner having an additive externally added thereto can be obtained.

The developing device of the image forming apparatus of the embodiment of the invention is selected according to the conveying speed of the electrostatic charge carrying member. In the case of a high-speed printer having a large conveying speed of the electrostatic charge carrying member, development with only one developing magnetic roller is not necessarily sufficient, and therefore, it is often the case that the developing area is expanded by using plural developing magnetic rollers to prolong the developing time. In the case where plural developing magnetic roller are used, higher developing capability can be obtained in comparison to the case using only one developing roller, whereby not only an image with large area can be printed and printing quality is improved, but also the toner content upon developing can be reduced, and the rotation speed of the developing rollers can be reduced. According to the measures, carrier consumption can be prevented by reducing scattering of the toner and load on the developer, whereby the service life of the two-component developer can be prolonged.

In the developing system using plural developing rollers, high developing capability can be obtained by forward unidirectional development, in which the developing rollers are rotated in the same direction as the traveling direction of the electrostatic charge carrying member, but such problems arise that background fogging is liable to occur, and defects at a front edge of an image and brush lines of the magnetic brush are liable to occur.

In the case of backward unidirectional development, in which the developing rollers are rotated in the opposite direction to the traveling direction of the electrostatic charge carrying member, background fogging is small, and brush lines of the magnetic brush are not liable to occur although defects at a back edge of an image may be formed, so as to provide an image stably. In the backward unidirectional development, however, the developing capability is small since the effective toner amount in contact with the electrostatic charge carrying member is small. The center feed system has the features of both the forward and backward unidirectional development systems to avoid the disadvantages of the systems. A developing device of the center feed system is disclosed, for example, in JP-B-62-45552.

Figure 2:
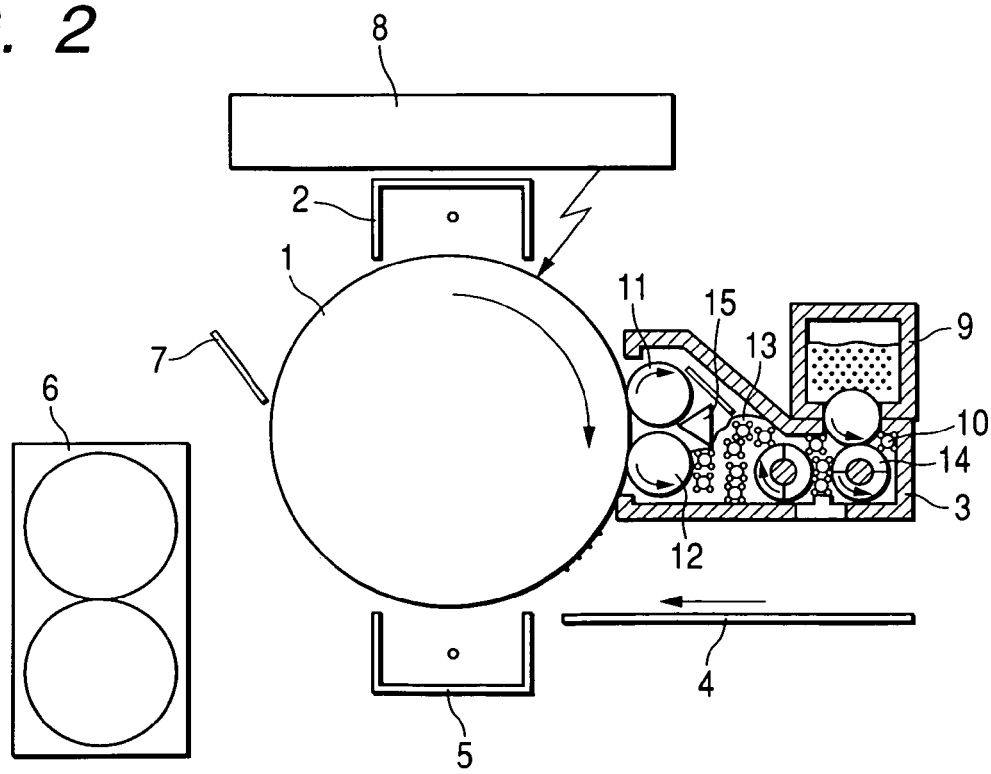
FIG. 2 is a schematic constitutional view showing an image forming apparatus according to an embodiment of the invention.

FIG. 2 is a schematic constitutional view showing an embodiment of an image forming apparatus equipped with a center feed developing device. In the image forming apparatus shown in FIG. 2, a surface of a photoreceptor 1 in a drum form, which is an electrostatic charge carrying member, is uniformly charged with a charging device 2, and an electrostatic latent image is formed on the photoreceptor 1 with an optical device 8.

The electrostatic latent image is visualized with a developing device 3 to form a toner image on the photoreceptor 1. The developing device 3 has a structure of a center feed system, in which a backward developing magnetic roller 11 rotating in the opposite direction to the traveling direction of the photoreceptor 1 and a forward developing magnetic roller 12 rotating in the same direction as the traveling direction of the photoreceptor 1 are disposed to face each other. The developing device 3 has, in addition to the developing magnetic rollers, a two-component developer 13 including a toner 9 and a carrier 10, an agitating member 14, a restricting member 15 and the like. The embodiment shown in FIG. 2 has one backward developing magnetic roller 11 and one forward developing magnetic roller 12, but the number of rollers may be increased depending on necessity.

The toner image on the photoreceptor 1 is transferred to a recording medium 4 with a transferring device 5. The toner remaining on the photoreceptor 1 is removed with a cleaning device 7. The toner image thus transferred to the recording medium 4 is fixed thereto with a fixing device to form a recorded image.

By using the combination of the developing system and the toner, excellent image quality can be obtained, and stable toner adhesion amounts can be ensured on both a character part and a solid image part, whereby such a stable image forming apparatus can be provided that is free of transfer defects occurring upon changing the printing density.

By using the image forming apparatus according to the embodiment of the invention, 20,000 sheets are printed with a printing density of 1.5%, and then a solid image and a half-tone image, such as an image with repeated 4 printed dots and 4 non-printed dots (non-character patterns), are printed. It is confirmed that no white spot or density unevenness occurs. Furthermore, it is confirmed that in the case where the ratio of a toner adhesion amount in a character part to a toner adhesion amount in a solid image part upon printing is more than 0.5 and less than 4, both the image density of a solid image and the prevention of thinning of characters can be simultaneously attained, and also worm holes can be prevented, whereby a stable image forming apparatus can be provided.

The embodiment of the invention will be described in more detail below with reference to the examples, but the embodiment of the invention is not construed as being limited thereto.

(Production of Toner 1)

A polyester resin (1) (flow beginning temperature Tfb: 91.0° C., softening point T1/2: 108.5° C., Mw: 7,400, Tg: 57.6° C., acid value: 6.8 mgKOH/g) and a polyester resin (2) (flow beginning temperature Tfb: 117.3° C., softening point T1/2: 153.9° C., Mw: 4,900, Tg: 56.3° C., acid value: 3.7 mgKOH/g) were mixed at a ratio of 50/50. 93 parts by weight of the polyester resin, 0.5 part by weight of boro-bis(1,1-diphenyl-1-oxo-acetyl)potassium salt, 4.0 parts by weight of C.I. Pigment Blue 15:3 and 2.5 parts by weight of carnauba wax (Carnauba Wax No. 1, a trade name, produced by Cerarica Noda Co., Ltd.) as raw materials were preliminarily mixed in a super mixer and then kneaded under heat with a biaxial kneader. After cooling, the mixture was pulverized, and classified with a dry air flow classification apparatus to obtain a toner mother material α having an average particle diameter of 9 μm. 0.4 part by weight of hydrophobic silica (primary particle diameter: 7 nm, R976, a trade name, produced by Nippon Aerosil Co., Ltd.) and 0.4 part by weight of inorganic particles (primary particle diameter: 40 nm, RX50, a trade name, produced by Nippon Aerosil Co., Ltd.) were added to 100 parts by weight of the toner mother material α and agitated with a Henschel mixer to attach the hydrophobic silica to the surface of the particles, whereby a toner α' was obtained.

The toner α' was subjected to a vibration sieve to remove coarse particles.

EXAMPLE 1

In Example 1, a toner A was obtained by passing the toner α through a sieve having a mesh aperture of 106 μm, and the weight of the substance remaining on the sieve per 100 g of the toner α' was measured.

The toner A was mixed with a magnetic carrier having a silicone coating on the surface thereof in a proportion of 4.5% by weight, and agitated to obtain a two-component developer. By using the developer, images were formed with an electrophotographic laser printer using an OPC as a photoreceptor at a charge potential of OPC of −500 V, a residual potential of −50 V, a developing bias potential of −350 V, a developing part contrast potential of 150 V and a printing speed of 70 sheets per minute (printing process speed: 31.4 m/sec). The developing device used was a center feed developing device having a developing magnetic roller rotating in the same direction as the traveling direction of the electrostatic charge carrying member (333 rpm) and a developing magnetic roller rotating in the opposite direction thereto, and an image was formed by reversal development with a developing gap (the distance between the photoreceptor and the sleeve of the developing roller) of 0.5 mm. The fixing device used had a heat roller formed by coating an aluminum core with a thin fluorine resin tube (a tetrafluoroethylene-perfluoroalkyl vinyl ether (PFA), thickness: 40 μm), and a backup roller formed by coating an aluminum core with a silicone rubber layer having a rubber hardness of 30 degree (thickness: 7 mm), which was further coated with a PFA tube as the outermost layer. The fixing conditions were a process speed of 31.4 cm/sec, outer diameters of the heat roller and the backup roller of 60 mm, a pressing load of 60 kgf and a contact width of the rollers (a nip width) of about 7 mm.

Upon evaluation, 20,000 sheets were printed with a printing density of 1.5%. Thereafter, three sheets of solid images and five sheets of half-tone images, such as non-character pattern images with repeated 4 printed dots and 4 non-printed dots, were printed on 55-kg paper, and occurrence of white spots and density unevenness and uniformity of a solid image were confirmed. Furthermore, five sheets of images including characters and thin lines were printed on 135-kg paper, and worm holes were confirmed.

EXAMPLE 2

In Example 2, a toner B was obtained by passing the toner α' through a sieve having a mesh aperture of 75 μm, and the weight of the substance remaining on the sieve per 100 g of the toner α' was measured.

The toner B was mixed with a magnetic carrier having a silicone coating on the surface thereof in a proportion of 4.5% by weight, and agitated to obtain a two-component developer. The evaluation of printing, i.e., occurrence of white spots and density unevenness and uniformity of a solid image, was carried out, and occurrence of worm holes was confirmed, in the same manner as in Comparative Example 1.

Comparative Example 1

In Comparative Example 1, a toner C was obtained bypassing the toner α' through a sieve having a mesh aperture of 63 μm, and the weight of the substance remaining on the sieve per 100 g of the toner α' was measured.

The toner C was mixed with a magnetic carrier having a silicone coating on the surface thereof in a proportion of 4.5% by weight, and agitated to obtain a two-component developer. The evaluation of printing, i.e., occurrence of white spots and density unevenness and uniformity of a solid image, was carried out, and occurrence of worm holes was confirmed, in the same manner as in Comparative Example 1.

Comparative Example 2

In Comparative Example 2, a toner D was obtained by passing the toner α' through a sieve having a mesh aperture of 45 μm, and the weight of the substance remaining on the sieve per 100 g of the toner α' was measured.

The toner D was mixed with a magnetic carrier having a silicone coating on the surface thereof in a proportion of 4.5% by weight, and agitated to obtain a two-component developer. The evaluation of printing, i.e., occurrence of white spots and density unevenness and uniformity of a solid image, was carried out, and occurrence of worm holes was confirmed, in the same manner as in Comparative Example 1.

Comparative Example 3

In Comparative Example 3, a toner E was obtained by passing the toner α' through a sieve having a mesh aperture of 38 μm, and the weight of the substance remaining on the sieve per 100 g of the toner α' was measured.

The toner D was mixed with a magnetic carrier having a silicone coating on the surface thereof in a proportion of 4.5% by weight, and agitated to obtain a two-component developer. The evaluation of printing, i.e., occurrence of white spots and density unevenness and uniformity of a solid image, was carried out, and occurrence of worm holes was confirmed, in the same manner as in Example 1.

(Production of Toner 2)

86 parts by weight of a styrene-acrylate copolymer (Mw: 238,000, Mn: 3,500, Himer SB316, a trade name, produced by Sanyo Chemical Industries, Ltd.), 1 part by weight of a chromium-including metallic dye (Bontron S-34, a trade name, produced by Orient Chemical Industries, Ltd.), 8 parts by weight of carbon black (MA-100, a trade name, produced by Mitsubishi Chemical Corp.), 1 part by weight of paraffin wax (polystyrene conversion molecular weight Mn: 440, DSC endothermic peak: 53.3° C. and 67.8° C., HNP-3, a trade name, produced by Nippon Seiro Co., Ltd.) and 4 parts by weight of polyethylene wax (polystyrene conversion molecular weight Mn: 430, DSC endothermic peak: 60.9° C. and 70.6° C., melt viscosity at 140° C.: 8.5 cp, crystallinity: 83%, Neowax AL, a trade name, produced by Yasuhara Chemical Co., Ltd.) as raw materials were preliminarily mixed in a super mixer and then kneaded under heat with a biaxial kneader. After cooling, the mixture was pulverized, and classified with a dry air flow classification apparatus to obtain a toner mother material a having an average particle diameter of 9 μm. 0.8 part by weight of hydrophobic silica (R972, a trade name, produced by Nippon Aerosil Co., Ltd.) was added to 100 parts by weight of the toner mother material β and agitated with a Henschel mixer to attach the hydrophobic silica to the surface of the particles, whereby a toner β' was obtained.

The toner β' was subjected to a vibration sieve to remove coarse particles.

EXAMPLE 3

In Example 3, a toner F was obtained by passing the toner β' through a sieve having a mesh aperture of 106 μm, and the weight of the substance remaining on the sieve per 100 g of the toner β' was measured.

The toner F was mixed with a magnetic carrier having a silicone coating on the surface thereof in a proportion of 4.5% by weight, and agitated to obtain a two-component developer. The evaluation of printing, i.e., occurrence of white spots and density unevenness and uniformity of a solid image, was carried out, and occurrence of worm holes was confirmed, in the same manner as in Example 1.

EXAMPLE 4

In Example 4, a toner G was obtained by passing the toner β' through a sieve having a mesh aperture of 75 μm, and the weight of the substance remaining on the sieve per 100 g of the toner β' was measured.

The toner G was mixed with a magnetic carrier having a silicone coating on the surface thereof in a proportion of 4.5% by weight, and agitated to obtain a two-component developer. The evaluation of printing, i.e., occurrence of white spots and density unevenness and uniformity of a solid image, was carried out, and occurrence of worm holes was confirmed, in the same manner as in Example 1.

EXAMPLE 5

In Example 5, a toner H was obtained by passing the toner β' through a sieve having a mesh aperture of 63 μm, and the weight of the substance remaining on the sieve per 100 g of the toner β' was measured.

The toner H was mixed with a magnetic carrier having a silicone coating on the surface thereof in a proportion of 4.5% by weight, and agitated to obtain a two-component developer. The evaluation of printing, i.e., occurrence of white spots and density unevenness and uniformity of a solid image, was carried out, and occurrence of worm holes was confirmed, in the same manner as in Example 1.

Comparative Example 4

In Comparative Example 4, a toner I was obtained by passing the toner β' through a sieve having a mesh aperture of 45 μm, and the weight of the substance remaining on the sieve per 100 g of the toner β' was measured.

The toner I was mixed with a magnetic carrier having a silicone coating on the surface thereof in a proportion of 4.5% by weight, and agitated to obtain a two-component developer. The evaluation of printing, i.e., occurrence of white spots and density unevenness and uniformity of a solid image, was carried out, and occurrence of worm holes was confirmed, in the same manner as in Example 1.

Comparative Example 5

In Comparative Example 5, a toner J was obtained by passing the toner β' through a sieve having a mesh aperture of 38 μm, and the weight of the substance remaining on the sieve per 100 g of the toner β' was measured.

The toner J was mixed with a magnetic carrier having a silicone coating on the surface thereof in a proportion of 4.5% by weight, and agitated to obtain a two-component developer. The evaluation of printing, i.e., occurrence of white spots and density unevenness and uniformity of a solid image, was carried out, and occurrence of worm holes was confirmed, in the same manner as in Example 1.

Comparative Example 6

In Comparative Example 6, a toner K was obtained by passing the toner β' through a sieve having a mesh aperture of 25 μm, and the weight of the substance remaining on the sieve per 100 g of the toner β' was measured.

The toner K was mixed with a magnetic carrier having a silicone coating on the surface thereof in a proportion of 4.5% by weight, and agitated to obtain a two-component developer. The evaluation of printing, i.e., occurrence of white spots and density unevenness and uniformity of a solid image, was carried out, and occurrence of worm holes was confirmed, in the same manner as in Example 1.

TABLE 1

| | Toner | Mesh aperture (μm) | Remaining weight on sieve (mg) | Toner adhesion amount in character part ($mg/cm^2$) | Toner adhesion amount in solid image part ($mg/cm^2$) | White spots | Worm holes | Uniformity of solid image | Total evaluation |
|---|---|---|---|---|---|---|---|---|---|
| Comparative Example 1 | A | 106 | 5 | 1.2 | 0.8 | D | good | good | poor |
| Comparative Example 2 | B | 75 | 16 | 1.2 | 0.8 | D | good | good | poor |
| Comparative Example 3 | C | 63 | 27 | 1.2 | 0.8 | C | good | good | poor |
| Example 1 | D | 45 | 36 | 1.2 | 0.8 | A | good | good | good |
| Example 2 | E | 38 | 42 | 1.2 | 0.8 | A | good | good | good |
| Comparative Example 4 | F | 106 | 4 | 0.9 | 0.7 | C | good | good | poor |
| Comparative Example 5 | G | 75 | 5 | 0.9 | 0.7 | C | good | good | poor |
| Comparative Example 6 | H | 63 | 7 | 0.9 | 0.7 | B | good | good | poor |
| Example 3 | I | 45 | 8 | 0.9 | 0.7 | A | good | good | good |
| Example 4 | J | 38 | 8 | 0.9 | 0.7 | A | good | good | good |
| Example 5 | K | 25 | 9 | 0.9 | 0.7 | A | good | good | good |

In Table 1, the evaluation of white spots was made in the following grades.

A: no white spot confirmed

B: 2 or less white spots confirmed per sheet

C: 3 to 10 white spots confirmed per sheet

D: 10 or more white spots confirmed per sheet

It was understood from Table 1 that white spots were confirmed in Comparative Examples 1 to 3, and no white spot was confirmed in Examples 1 and 2. It was understood from the result that white spots occurred mainly by particles remaining on a sieve of 45 μm or more, and white spots could be prevented from occurring by removing remaining particles having a diameter of 45 μm or more.

Even in the toners with a relatively small weight of the residue on the sieve, such as Examples 3 to 5 and Comparative Examples 4 to 6, the toners including particles having a diameter of 45 μm or more (Comparative Examples 4 to 6) exhibited white spots in the case where after repeatedly printing with a low printing density, solid images and half-tone images of non-character patterns with repeated 4 printed dots and 4 non-printed dots.

Comparative Example 7

In Comparative Example 7, the evaluation of printing was carried out by using the toner D and changing the conditions to a charge potential of OPC of −700 V, a residual potential of −50 V, a developing bias potential of −550 V and a developing part contrast potential of 150 V. Upon printing, the toner adhesion amount in a character part was 1.8 mg/cm$^2$, and the toner adhesion amount in a solid image part was 1.2 mg/cm$^2$. Wormholes were confirmed although no white spot was found.

EXAMPLE 6

In Example 6, the evaluation of printing was carried out by using the toner D and changing the conditions to a charge potential of OPC of −350 V, a residual potential of −50 V, a developing bias potential of −200 V and a developing part contrast potential of 150 V. Upon printing, the toner adhesion amount in a character part was 0.7 mg/cm$^2$, and the toner adhesion amount in a solid image part was 0.6 mg/cm$^2$. No white spot or worm hole was found.

Comparative Example 8

In Comparative Example 8, a large amount of carbon black was added to the coating material for the magnetic carrier used for preparing the two-component developer to suppress the resistance of the magnetic carrier to a low value. The toner D was added to the low resistance magnetic carrier in a proportion of 4.5% to produce a two-component developer, and the evaluation of printing was carried out at a charge potential of OPC of −350 V, a residual potential of −50 V, a developing bias potential of −200 V and a developing part contrast potential of 150 V. Upon printing, the toner adhesion amount in a character part was 0.3 mg/cm$^2$, and the toner adhesion amount in a solid image part was 1.0 mg/cm$^2$. No white spot or worm hole was found, but characters and thin lines were thinned down.

Comparative Example 9

In Comparative Example 9, no carbon black was added to the coating material for the magnetic carrier used for preparing the two-component developer to increase the resistance of the magnetic carrier. The toner D was added to the high resistance magnetic carrier in a proportion of 4.5% to produce a two-component developer, and the evaluation of printing was carried out at a charge potential of OPC of −500 V, a residual potential of −50 V, a developing bias potential of −350 V and a developing part contrast potential of 150 V. Upon printing, the toner adhesion amount in a character part was 1.5 mg/cm$^2$, and the toner adhesion amount in a solid image part was 0.3 mg/cm$^2$. No white spot or worm hole was found, but uniformity of a solid image was deteriorated.

EXAMPLE 7

In Example 7, the toner J was added to the magnetic carrier in a proportion of 5.5% by weight to produce a two-component developer, and the evaluation of printing was carried out at a charge potential of OPC of −500 V, a residual potential of −50 V, a developing bias potential of −350 V and a developing part contrast potential of 150 V. Upon printing, the toner adhesion amount in a character part was 1.0 mg/cm$^2$, and the toner adhesion amount in a solid image part was 0.9 mg/cm$^2$. No white spot or worm hole was found.

Comparative Example 10

In Comparative Example 10, the evaluation of printing was carried out under the same conditions as in Example 7 except that the rotation number of the developing magnetic rollers was changed to 500 rpm. Upon printing, the toner adhesion amount in a character part was 0.5 mg/cm$^2$, and the toner adhesion amount in a solid image part was 1.2 mg/cm$^2$. No white spot or worm hole was found, but characters and thin lines were thinned down.

EXAMPLE 8

In Example 8, the evaluation of printing was carried out under the same conditions as in Example 7 except that the rotation number of the developing magnetic rollers was changed to 233 rpm. Upon printing, the toner adhesion amount in a character part was 1.3 mg/cm$^2$, and the toner adhesion amount in a solid image part was 0.6 mg/cm$^2$. No white spot or worm hole was found.

Comparative Example 11

In Comparative Example 11, the evaluation of printing was carried out under the same conditions as in Example 7 except that the rotation number of the developing magnetic rollers was changed to 167 rpm. Upon printing, the toner adhesion amount in a character part was 1.7 mg/cm$^2$, and the toner adhesion amount in a solid image part was 0.4 mg/cm$^2$. No white spot was found, but worm holes occurred.

TABLE 2

| | Toner | Mesh aperture (μm) | Remaining weight on sieve (mg) | Toner adhesion amount in character part (mg/cm$^2$) | Toner adhesion amount in solid image part (mg/cm$^2$) | Ratio of toner adhesion amount in character part/ toner adhesion amount in solid image part | White spots | Worm holes | Thinning down of characters and thin lines | Uniformity of solid image | Total evaluation |
|---|---|---|---|---|---|---|---|---|---|---|---|
| Comparative Example 7 | D | 45 | 36 | 1.8 | 1.2 | 1.50 | good | poor | good | good | poor |
| Comparative | D | 45 | 36 | 0.3 | 1.0 | 0.30 | good | good | poor | good | poor |

TABLE 2-continued

| | Toner | Mesh aperture (μm) | Remaining weight on sieve (mg) | Toner adhesion amount in character part ($mg/cm^2$) | Toner adhesion amount in solid image part ($mg/cm^2$) | Ratio of toner adhesion amount in character part/ toner adhesion amount in solid image part | White spots | Worm holes | Thinning down of characters and thin lines | Uniformity of solid image | Total evaluation |
|---|---|---|---|---|---|---|---|---|---|---|---|
| Example 8 | | | | | | | | | | | |
| Comparative Example 9 | D | 45 | 36 | 1.5 | 0.3 | 5.00 | good | good | good | poor | poor |
| Example 6 | D | 45 | 36 | 0.7 | 0.6 | 1.17 | good | good | good | good | good |
| Comparative Example 10 | J | 38 | 8 | 0.5 | 1.2 | 0.42 | good | good | poor | good | poor |
| Comparative Example 11 | J | 38 | 8 | 1.7 | 0.4 | 4.25 | good | poor | good | poor | poor |
| Example 7 | J | 38 | 8 | 1.0 | 0.9 | 1.11 | good | good | good | good | good |
| Example 8 | J | 38 | 8 | 1.3 | 0.6 | 2.17 | good | good | good | good | good |

It was understood from Table 2 that worm holes were confirmed in the case where the toner adhesion amount in a character part exceeded 1.6 $mg/cm^2$. Furthermore, in the case where the ratio of the toner adhesion amount in a character part to the toner adhesion amount in a solid image part was smaller than 0.5, characters and thin lines were thinned down to impair recognition of characters. In the case where the ratio of the toner adhesion amount in a character part to the toner adhesion amount in a solid image part exceeded 4, the uniformity of a solid image was deteriorated.

The aforementioned evaluations were repeated in Examples 6 to 8 by printing 100,000 sheets in total. As a result, no white spot or worm hole occurred, and stable images could be obtained.

What is claimed is:

1. An image forming apparatus comprising:

an electrostatic charge carrying member on which an electrostatic latent image is formed to be visualized;

a transferring member transferring a toner image to be visualized to a recording medium or to the recording medium through an intermediate transfer material;

a fixing member fixing the toner image, which is transferred to the recording medium, to obtain a recorded image; and a toner obtained by pulverization, which includes at least a fixing resin, a colorant, a releasing agent, and an external additive, wherein the toner has an average particle diameter in a range of from 4 to 12 μm and including no particle having a diameter of 45 μm or more, and wherein a ratio of a toner adhesion amount in a character part to a toner adhesion amount in a solid image part upon printing is more than 0.5 and less than 4, where the toner adhesion amount in a character part is 1.6 $mg/cm^2$ or less.

2. An image forming apparatus comprising:

an electrostatic charge carrying member on which an electrostatic latent image is formed to be visualized;

a transferring member transferring a toner image to be visualized to a recording medium or to the recording medium through an intermediate transfer material; and a fixing member fixing the toner image, which is transferred to the recording medium, to obtain a recorded image, wherein the toner image is formed with a two component developer including:

a toner having at least a binder resin, a colorant a releasing agent, and an external additive, and having an average particle diameter in a range of from 4 to 12 μm and including no particle having a diameter of 45 μm or more; and a magnetic carrier, and wherein a ratio of a toner adhesion amount in a character part to a toner adhesion amount In a solid image part upon printing is more than 0.5 and less than 4, where the toner adhesion amount in a character part is 1.6 $mg/cm^2$ or less.

3. The image forming apparatus according to claim 1, wherein the toner comprises a color toner.

4. The image forming apparatus according to claim 2, wherein the toner comprises a color toner.

5. The image forming apparatus according to claim 2, wherein the magnetic carrier comprises one compound selected from the group consisting of magnetite, spinel ferrite, and magnetoplumbite ferrite.

6. The image forming apparatus according to claim 2, wherein the magnetic carrier comprises one compound selected from the group consisting of gamma iron oxide and barium ferrite.

7. The image forming apparatus according to claim 2, wherein the surface of the magnetic carrier is coated with at least one compound selected from the group consisting of a silicone resin, an acrylic resin, an epoxy resin, and a fluorine resin.

8. A toner for an image forming apparatus, comprising:

a fixing resin;

a colorant;

a releasing agent; and an external additive, wherein the toner has an average particle diameter in a range of from 4 to 12 μm and including no particle having a diameter of 45 μm or more, wherein a ratio of a toner adhesion amount in a character part to a toner adhesion amount in a solid image part upon printing is more than 0.5 and less than 4, where the toner adhesion amount in a character part is 1.6 $mg/cm^2$ or less, and wherein the toner is obtained by pulverization.

9. The toner according to claim 8, wherein a proportion of particles having a diameter of 4 μm or less included in the toner is 15% by number or less.

10. The toner according to claim 8, wherein a proportion of particles having a diameter of 4 μm or less included in the toner is 10% by number or less.

11. The image forming apparatus according to claim 4, wherein the toner comprises a magnetic material including at least one compound selected from the group consisting of iron oxide, a metal, and an alloy of the metals.

12. The image forming apparatus according to claim 11, wherein the magnetic material has an average particle diameter of 2 μm or less.

13. The image forming apparatus according to claim 11, wherein the magnetic material has an average particle diameter from 0.1 to 0.5 μm.

14. The image forming apparatus according to claim 1, wherein a proportion of particles having a diameter of 4 μm or less included in the toner is 15% by number or less.

15. The image farming apparatus according to claim 1, wherein a proportion of particles having a diameter of 4 μm or less included in the toner is 10% by number or less.

16. The image forming apparatus according to claim 2, wherein a proportion of particles having a diameter of 4 μm or less included in the toner is 15% by number or less.

17. The image forming apparatus according to claim 2, wherein a proportion of particles having a diameter of 4 μm or less included in the toner is 10% by number or less.

18. The image forming apparatus according to claim 2, wherein the toner comprises a magnetic material including at feast one compound selected from the group consisting of iron oxide, a metal, and an alloy of the metals.

19. The image forming apparatus according to claim 18, wherein the magnetic material has an average particle diameter of 2 μm or less.

20. The image forming apparatus according to claim 2, wherein the toner is obtained by pulverization.

* * * * *